US006512493B2

(12) United States Patent
Park et al.

(10) Patent No.: US 6,512,493 B2
(45) Date of Patent: Jan. 28, 2003

(54) CHIP ANTENNA

(75) Inventors: Heung-Soo Park, Sungnam (KR); Jae-Suk Sung, Suwon (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/002,002

(22) Filed: Dec. 5, 2001

(65) Prior Publication Data

US 2003/0001794 A1 Jan. 2, 2003

(30) Foreign Application Priority Data

Jul. 2, 2001 (KR) ..... 2001-39335
Nov. 15, 2001 (KR) ..... 2001-70956

(51) Int. Cl.[7] ..... H01Q 1/36; H01Q 1/38

(52) U.S. Cl. ..... 343/895; 343/700 MS; 343/702; 343/783

(58) Field of Search ..... 343/700 MS, 702, 343/783, 769, 788, 895

(56) References Cited

U.S. PATENT DOCUMENTS 6,023,251 A * 2/2000 Koo et al. ..... 343/700 MS
6,124,831 A * 9/2000 Rutkowski et al. .. 343/700 MS
6,204,819 B1 * 3/2001 Hayes et al. ..... 343/700 MS
6,326,921 B1 * 12/2001 Egorov et al. ..... 343/700 MS
6,353,443 B1 * 3/2002 Ying ..... 343/700 MS
6,373,436 B1 * 4/2002 Chen et al. ..... 343/700 MS
6,380,895 B1 * 4/2002 Moren et al. ..... 343/700 MS
6,388,626 B1 * 5/2002 Gamalielsson et al. ..... 343/700 MS

FOREIGN PATENT DOCUMENTS

JP 10-93320 4/1998

* cited by examiner

*Primary Examiner*—Tan Ho
(74) *Attorney, Agent, or Firm*—Lowe Hauptman Gilman & Berner, LLP

(57) ABSTRACT

Disclosed herein is a chip antenna. The chip antenna has a base block, and primary and second conductor lines. The base block is comprised of opposite top and bottom surfaces and side surfaces between the top and bottom surfaces, and made of one of dielectric and magnetic substances. The primary conductor line is formed at a portion of the base block and formed in the shape of an inverted F. The secondary conductor line is formed in a portion of the base block and formed in the shape of an inverted L. The primary and secondary conductor lines are connected in parallel with each other.

22 Claims, 8 Drawing Sheets

CHIP ANTENNA

BACKGROUND OF THE INVENTION

1. Field of the Invention

The present invention relates generally to chip antennas used in mobile communication terminals and Local Area Networks (LANs), and more particularly to a chip antenna in which a conductor pattern comprised of primary and secondary conductor lines formed independently is formed on a rectangular solid-shaped base block made of a dielectric or magnetic substance, thus miniaturizing the chip antenna and improving the bandwidth of a single frequency of the chip antenna.

2. Description of the Prior Art

As well known to those skilled in the art, conventional mobile communication devices are each composed of a device body, and a bar antenna installed to be protruded from the upper portion of the device body and used for transmitting and receiving electric waves signals. Here, the resonance frequency of the antenna is determined by the entire length of a conductor composing the antenna.

However, the conventional antenna for mobile communication devices is problematic in that it fails to support the trend towards the miniaturization of mobile communication terminals due to its outward protrusion.

On the other hand, the construction of a chip antenna for solving this problem is shown in FIG. 1. Referring to FIG. 1, the chip antenna comprises a body 1 made of a dielectric material, a conductor 2 helically formed in and on the surface of the body 1 and comprised of dual conductor lines arranged in parallel with each other, and a feeding terminal 3 arranged on the surface of the body 1 so as to apply a voltage to the conductor 2. The conductor 2 is constructed such that one conductor line is connected to the other conductor line through a reversing unit 2*a*.

Accordingly, the frequency bandwidth of the chip antenna is widened by increasing areas of opposite conductor 2 and the ground so as to increase capacitance, while not increasing the entire length of the conductor 2.

However, the conventional chip antenna is disadvantageous in that the frequency bandwidth capable of being widened is restricted, and the antenna characteristics are greatly varied according to a distance between the parallel conductor lines, thus decreasing the reliability of the chip antenna.

SUMMARY OF THE INVENTION

Accordingly, the present invention has been made keeping in mind the above problems occurring in the prior art, and an object of the present invention is to provide a chip antenna, which can be miniaturized without the variation of its antenna characteristics.

Another object of the present invention is to provide a chip antenna, which is capable of increasing the bandwidth of a single frequency by making resonance frequencies of chip antenna conductor lines get near to each other, thus increasing a frequency bandwidth.

In accordance with one aspect of the present invention, the above and other objects can be accomplished by the provision of a chip antenna comprising a base block comprised of opposite top and bottom surfaces and side surfaces between the top and bottom surfaces, and made of one of dielectric and magnetic substances; a primary conductor line formed at a portion of the base block and formed in the shape of an inverted F; and a secondary conductor line formed at a portion of the base block and formed in the shape of an inverted L, wherein the primary and secondary conductor lines are connected in parallel with each other.

In accordance with another aspect of the present invention, there is provided a chip antenna comprising a base block made of one material of dielectric and magnetic substances and constructed in the form of a rectangular solid; a conductor pattern comprised of a primary conductor line having a plurality of side electrodes formed to helically wind around a portion of the base block and upper and lower electrodes connected to the side electrodes, the upper and lower electrodes each having extended portions formed therein, and a secondary conductor line formed inside of the base block such that the secondary conductor line is connected in parallel with the primary conductor line; ground and feeding terminals connected to the conductor pattern; and an impedance adjustment electrode formed at a portion of the top surface of the base block such that it is connected between the primary conductor line and the ground terminal so as to adjust impedance.

In accordance with still another aspect of the present invention, there is provided a chip antenna comprising a base block made of one material of dielectric and magnetic substances and constructed in the form of a rectangular solid; a conductor pattern comprised of a primary conductor line having a plurality of side electrodes formed to helically wind around at least one portion of the base block and upper and lower electrodes connected to the side electrodes, the upper and lower electrodes each having extended portions formed therein, and a secondary conductor line formed inside of the lower portion of the base block such that the secondary conductor line is arranged under the primary conductor line while being connected in parallel with the primary conductor line; ground and feeding terminals connected to the conductor pattern; and an impedance adjustment electrode formed at a portion of the top surface of the base block such that it is connected between the primary conductor line and the ground terminal so as to adjust impedance.

In accordance with still another aspect of the present invention, there is provided a chip antenna comprising a base block made of one material of dielectric and magnetic substances and constructed in the form of a rectangular solid; a conductor pattern comprised of a primary conductor line transversely arranged with respect to the base block and formed in the shape of a combined inverted F/meander line, and a secondary conductor line formed inside of the lower portion of the base block while being connected in parallel with the primary conductor line and formed in the shape of an inverted L; ground and feeding terminals connected to the conductor pattern; and an impedance adjustment electrode formed at a portion of the top surface of the base block such that it is connected between the primary conductor line and the ground terminal so as to adjust impedance.

In accordance with still another aspect of the present invention, there is provided a chip antenna comprising a base block made of one material of dielectric and magnetic substances and constructed in the form of a rectangular solid; a conductor pattern comprised of a primary conductor line arranged on the base block and formed in the shape of a plate such that the primary conductor line is transversely arranged with respect to the base block, and a secondary conductor line connected in parallel with the primary conductor line and formed in the shape of a plate, the secondary conductor line being formed inside of the lower portion of the base block such that it is arranged under the primary conductor line while being connected in parallel with the primary conductor line; ground and feeding terminals connected to the conductor pattern; and an impedance adjustment electrode formed at a portion of the top surface of the base block such that it is connected between the primary conductor line and the ground terminal so as to adjust impedance.

In accordance with still aspect of the present invention, there is provided a chip antenna comprising a base block made of one material of dielectric and magnetic substances and constructed in the form of a rectangular solid; a conductor pattern comprised of a primary conductor line arranged on the base block, formed in the shape of a slot and transversely arranged with respect to the base block, and a secondary conductor line connected in parallel with the primary conductor line and formed in the shape of a slot, the secondary conductor line being formed inside of the lower portion of the base block such that it is arranged under the primary conductor line while being connected in parallel with the primary conductor line; ground and feeding terminals connected to the conductor pattern; and an impedance adjustment electrode formed at a portion of the top surface of the base block such that it is connected between the primary conductor line and the ground terminal so as to adjust impedance.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
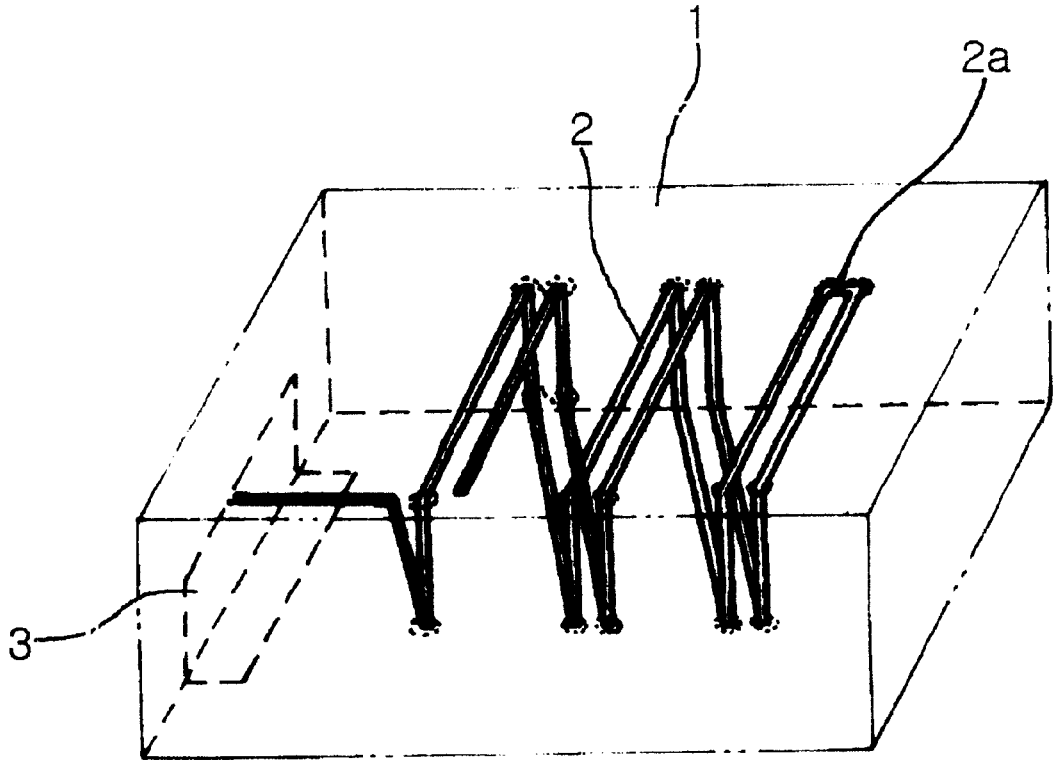
PRIOR ART FIG. 1
FIG. 1 is an exterior perspective view showing a conventional chip antenna.
Figure 2:
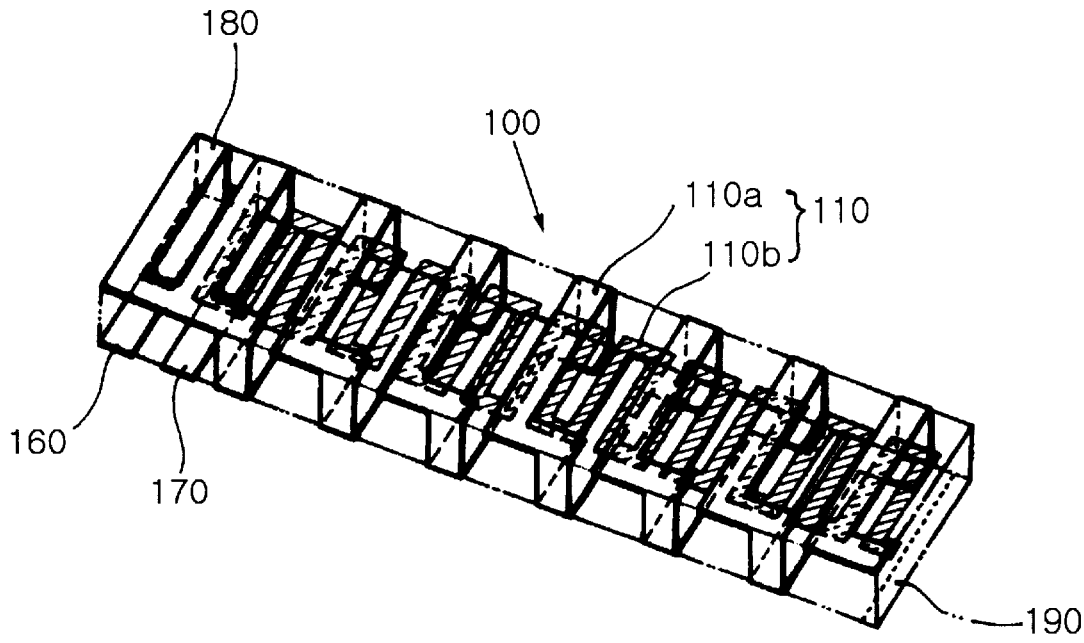
FIG. 2 is a perspective view showing a chip antenna according to a first embodiment of the present invention.
Figure 3:
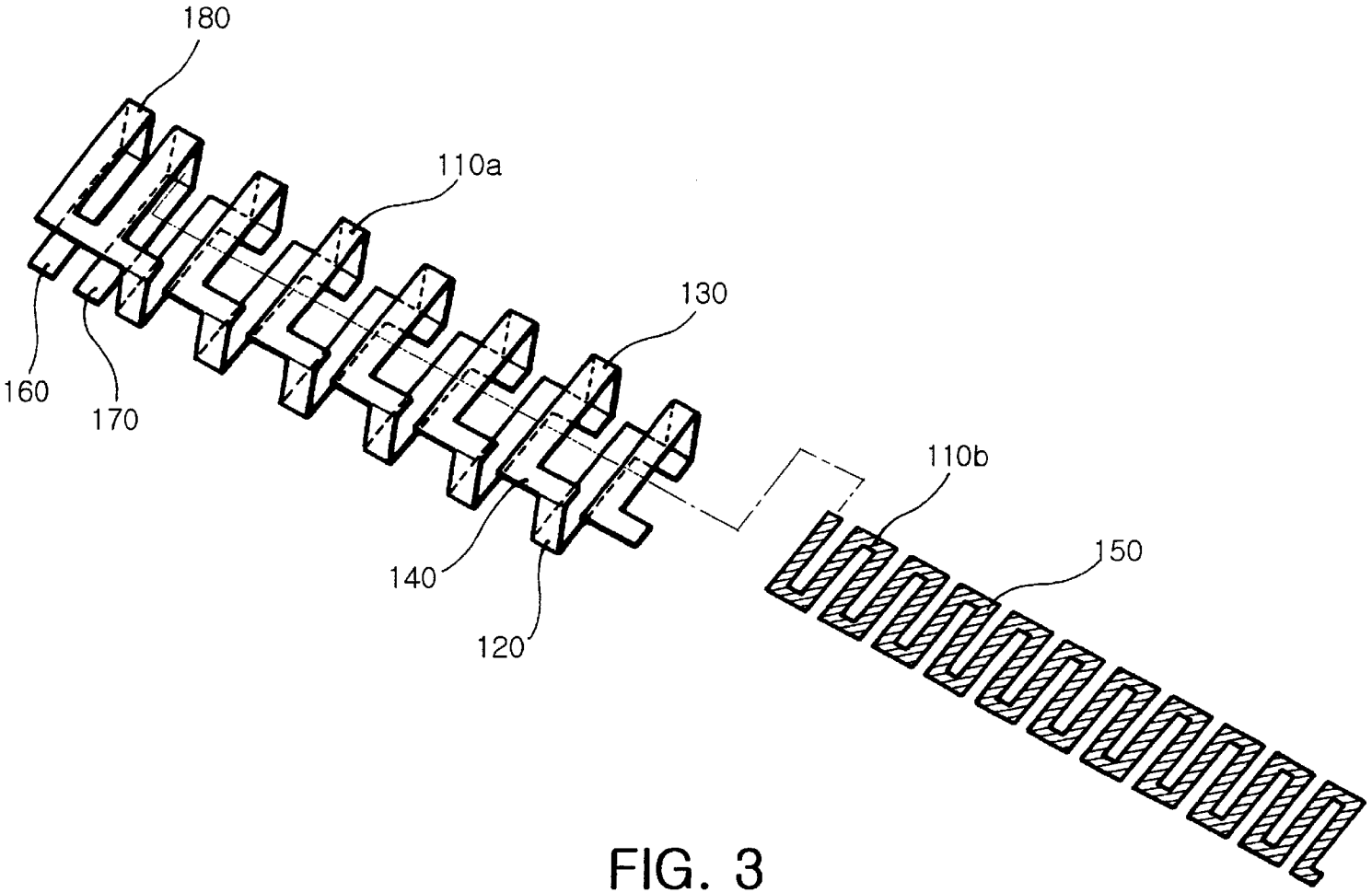
FIG. 3 is a perspective view showing a conductor pattern of the chip antenna of this invention.

Referring to FIGS. 2 and 3, a chip antenna of this invention comprises a base block 100, a conductor pattern 110, a ground terminal 160 formed in the base block 100 so as to be connected to the conductor pattern 110, a feeding terminal 170 and an impedance adjustment terminal 180.

The base block 100 is comprised of opposite top and bottom surfaces, and side surfaces between the top and bottom surfaces. Further, the base block 100 is made of one of dielectric and magnetic substances, or constructed in the form of a rectangular solid while being made of one of dielectric and magnetic substances.

The conductor pattern 110 formed in the base block 100 is comprised of a primary conductor line 10*a* having an inverted F shape and a secondary conductor line 110*b* connected in parallel with the inverted F-shaped primary conductor line 110*a*. Here, the secondary conductor line 110*b* can be formed in the shape of an inverted L.

The inverted F-shaped primary conductor line 110*a* is comprised of a plurality of side electrodes 120 formed in both side surfaces of the base block 100 transversely opposite to each other, and upper and lower electrodes 130 connected to the side electrodes 120. Here, the primary conductor line 110*a* helically winds around the outer surface of the base block 100, and extended portions 140 are projected at approximately 90 degrees from one end of each of the upper and lower electrodes 130.

Further, in the secondary conductor line 110*b*, an internal electrode 150 connected in parallel with the primary conductor line 110*a* is formed inside of the base block 100.

Further, the secondary conductor line 110*b* is connected to a portion of the feeding terminal 170 of the primary conductor line 110*a* and is extended along the length of the base block 100.

In this case, the shape of the internal electrode 150 can be selected from the group including helix, meander line bent vertically, line and plate shapes.

The ground terminal 160, the feeding terminal 170 and an antenna fixing terminal 190 are respectively formed at end portions of the outer surface of the base block 100 so as to be connected to the conductor pattern 110. The primary conductor line 110*a* is extended along the length of the base block 100, and includes the feeding terminal 170 and the ground terminal 160 connected to one end and the other end of the conductor pattern 110, respectively.

The impedance adjustment terminal 180 connected between the inverted F-shaped primary conductor line 110*a* and the ground terminal 160 is constructed such that it is connected to the primary conductor line 110*a* in at an end portion of the top surface of the base block 100 to occupy a predetermined area.

Hereinafter, the operation and effect of the present invention having the above construction is described in detail.

Referring to FIGS. 2 to 4, in the chip antenna of this invention, the conductor pattern 110 is formed in the base block 100 made of one of dielectric and magnetic substances and having a regular solid shape. Then, the ground terminal 160, the feeding terminal 170 and the antenna fixing terminal 190 are formed to be connected to the conductor pattern 110, thus completing the manufacture of the chip antenna.

Then, the impedance adjustment terminal 180 having a predetermined area is arranged between the conductor pattern 110 and the ground terminal 160, such that the area can be adjusted in the case that a portion of the impedance adjustment terminal 180 is eliminated, thus allowing impedance matching of the chip antenna to be adjusted.

The inverted F-shaped primary conductor line 110*a* composing the conductor pattern 110 is formed on the surface of the base block 100 through a screen print or a deeping process, and is printed to helically wind around the outer surface of the base block 100.

Figure 4A:
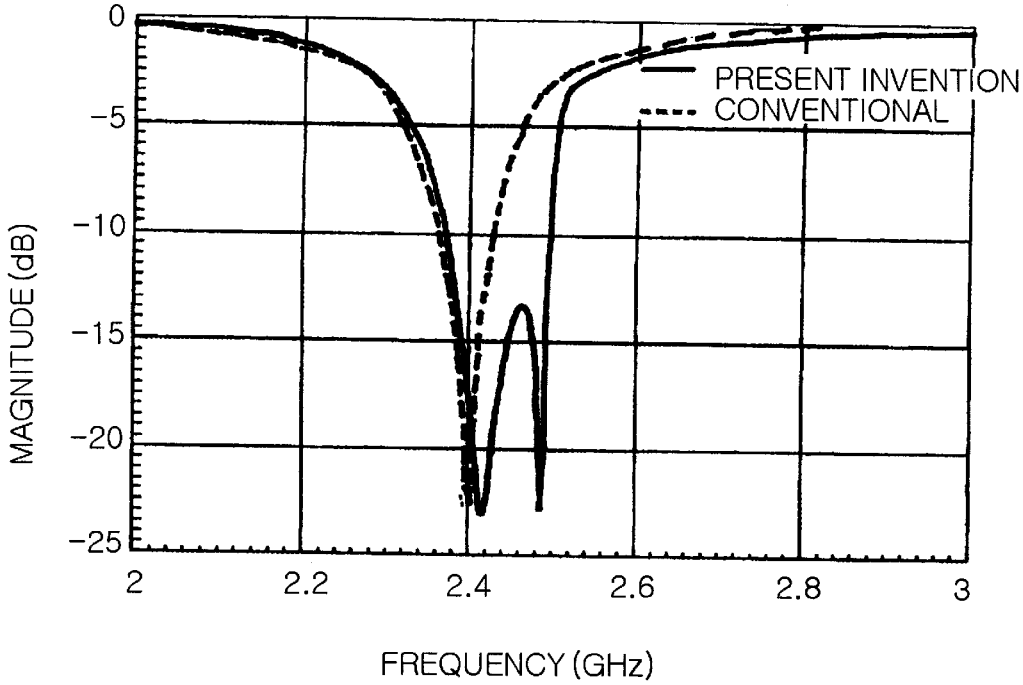
FIGS. 4*a* and 4*b* are graphic views showing the characteristic curves of the chip antenna of this invention.
Figure 4B:
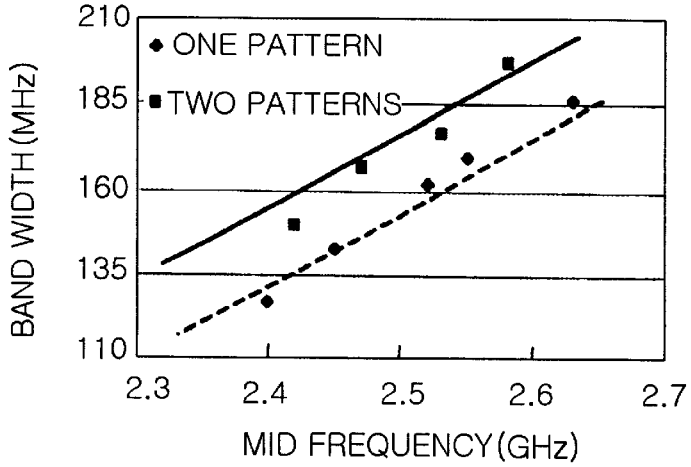

Further, when the inverted L-shaped secondary conductor line 110*b* is formed to be connected in parallel with the primary conductor line 110*a* inside of the primary conductor line 110*a*, two nearby resonance frequencies are independently generated by the primary and secondary conductor lines 110*a* and 110*b*, thus increasing the frequency bandwidth to more than two times that of a conventional chip antenna, as shown in FIGS. 4*a* and 4*b*.

Figure 5:
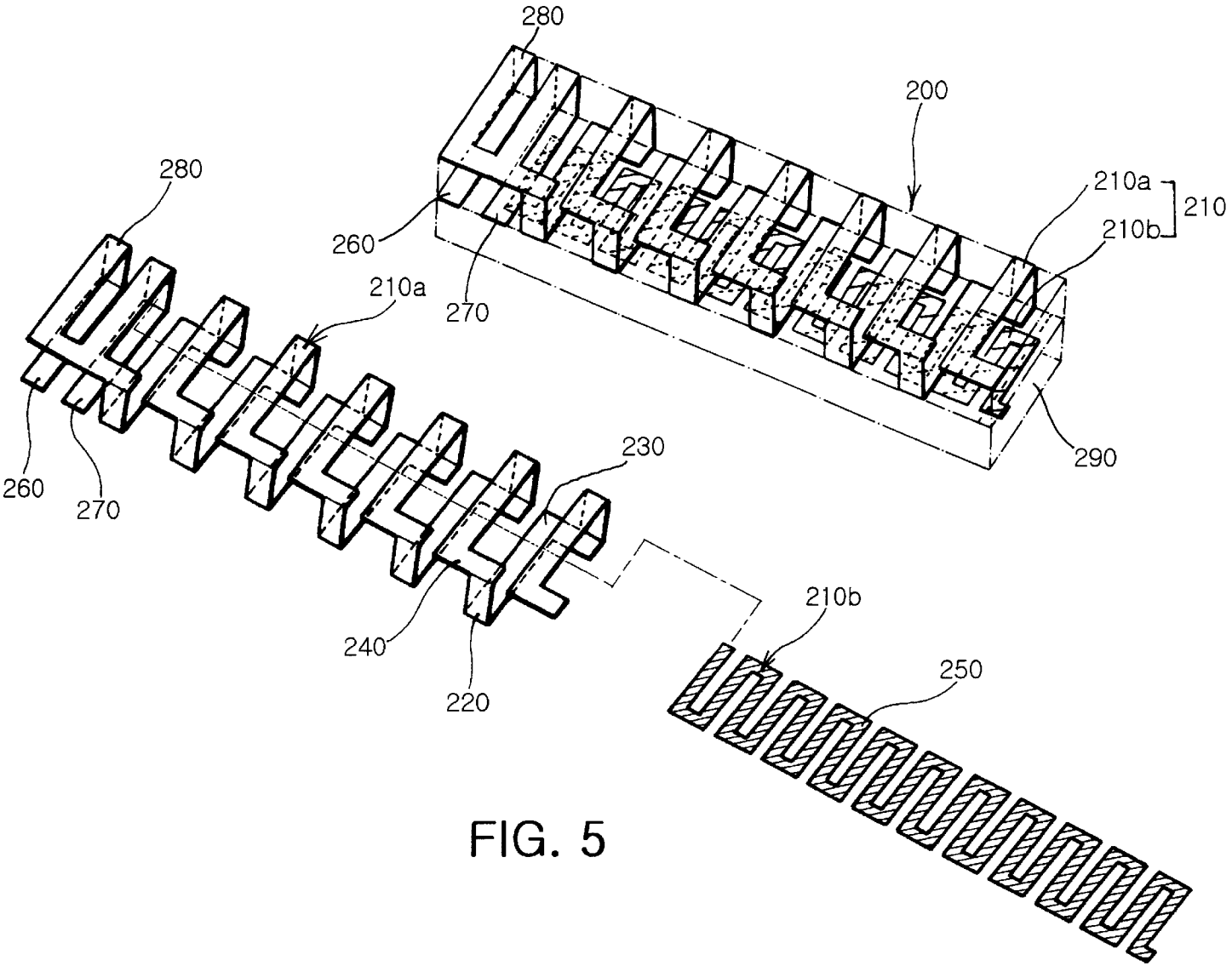
FIG. 5 is a perspective view showing the layered state of a conductor pattern of a chip antenna according to a second embodiment of this invention.

FIG. 5 is a view showing a conductor pattern 210 of a chip antenna according to another preferred embodiment of this invention. Referring to FIG. 5, a base block 200 of the chip antenna is made of one of dielectric and magnetic substances and constructed in the form of a rectangular solid.

The conductor pattern 210 formed in the base block 200 is comprised of a primary conductor line 210*a* having an inverted F shape, and a secondary conductor line 210*b* connected in parallel with the primary conductor line 210*a* and formed in the shape of an inverted L. The primary conductor line 210*a* is comprised of a plurality of side electrodes 220 formed in both side surfaces of the base block 200 transversely opposite to each other, and upper and lower electrodes 230 connected to the side electrodes 220. Here, the primary conductor line 210*a* helically winds around the upper portion of the base block 200, and extended portions 240 are projected at approximately 90 degrees from one end of each of the upper and lower electrodes 230.

Further, an internal electrode 250 is formed inside of the lower portion of the base block 200 such that the secondary conductor line 210*b* is arranged under the primary conductor line 210*a* while being connected in parallel with the primary conductor line 210*a*.

In this case, the shape of the internal electrode 250 can be selected from the group including helix, meander line bent vertically, line and plate shapes.

A ground terminal 260, a feeding terminal 270 and an antenna fixing terminal 290 are respectively formed at end portions of the outer surface of the base block 200 so as to be connected to the conductor pattern 210.

An impedance adjustment terminal 280 connected between the inverted F-shaped primary conductor line 210*a* and the ground terminal 260 is constructed such that it is connected to the primary conductor line 210*a* at an end portion of the top surface of the base block 200 to occupy a predetermined area.

Accordingly, even if the primary and secondary conductor lines 210*a* and 210*b* are connected in parallel with each other, and the secondary conductor line 210*b* is arranged under the primary conductor line 210*a*, the same effect as that of the first embodiment as shown in graphs of FIGS. 4*a* and 4*b* can be obtained.

Further, the internal electrode 250 is formed inside of the lower portion of the base block 200 such that the secondary conductor line 210*b* is arranged under the primary conductor line 210*a* while being connected in parallel with the primary conductor line 210*a*, and the primary and secondary conductor lines 210*a* and 210*b* form independent conductor lines to each have a unique resonance frequency.

Moreover, the ground terminal 260 connected to the conductor pattern 210 can be freely adjusted in its area on the surface of the base block 200, thus allowing impedance matching of the chip antenna to be freely adjusted.

Figure 6:
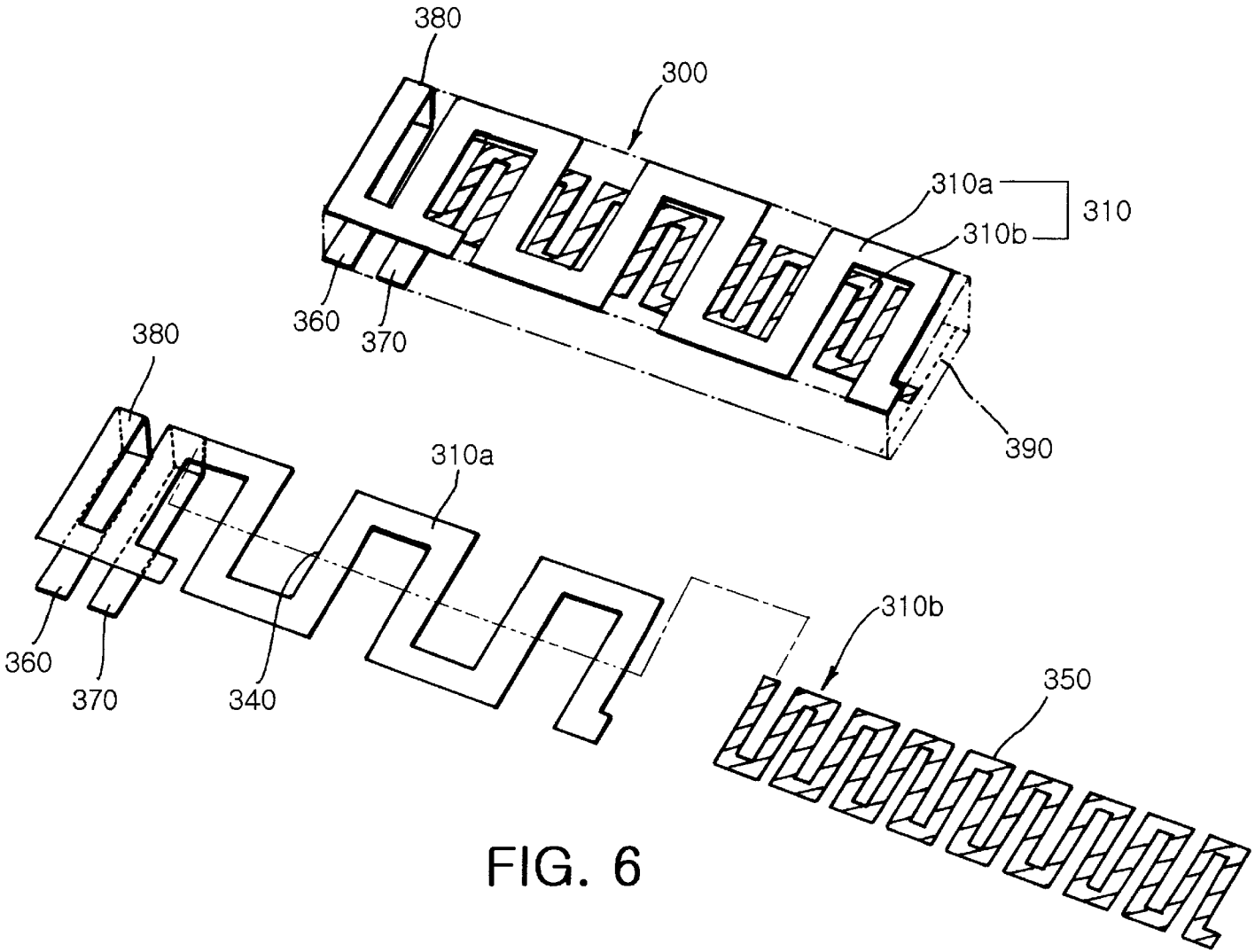
FIG. 6 is a view showing a conductor pattern of a chip antenna according to a third embodiment of this invention.

Meanwhile, FIG. 6 is a view showing a conductor pattern 310 of a chip antenna according to a third embodiment of this invention. Referring to FIG. 6, a base block 300 of the chip antenna is made of one of dielectric and magnetic substances, and constructed in the form of a rectangular solid.

The conductor pattern 310 formed on the base block 300 is comprised of a primary conductor line 310*a* having a combined inverted F/meander line shape, and a secondary conductor line 310*b* connected in parallel with the primary conductor line 310*a* and formed in the shape of an inverted L. Here, the primary conductor line 310*a* is formed in the shape of a meander line such that it is transversely arranged with respect to the base block 300. Further, extended portions 340 in which electrodes of the primary conductor line 310*a* are projected at approximately 90 degrees are formed in the primary conductor line 310*a*.

Further, the secondary conductor line 310*b* is arranged under the primary conductor line 310*a* while being connected in parallel with the primary conductor line 310*a*.

At this time, the shape of the internal electrode 350 can be selected from the group including helix, meander line bent vertically, line and plate shapes.

A ground terminal 360, a feeding terminal 370 and an antenna fixing terminal 390 are respectively formed at end portions of the outer surface of the base block 300 so as to be connected to the conductor pattern 310.

An impedance adjustment terminal 380 connected between the primary conductor line 310*a* and the ground terminal 360 is constructed such that it is connected to the primary conductor line 310*a* at an end portion of the top surface of the base block 300 to occupy a predetermined area.

Accordingly, even if the primary and secondary conductor lines 310*a* and 310*b* are connected in parallel with each other, and the secondary conductor line 310*b* is arranged under the primary conductor line 310*a*, the same effect as that of the first embodiment as shown in graphs of FIGS. 4*a* and 4*b* can be obtained.

Figure 7:
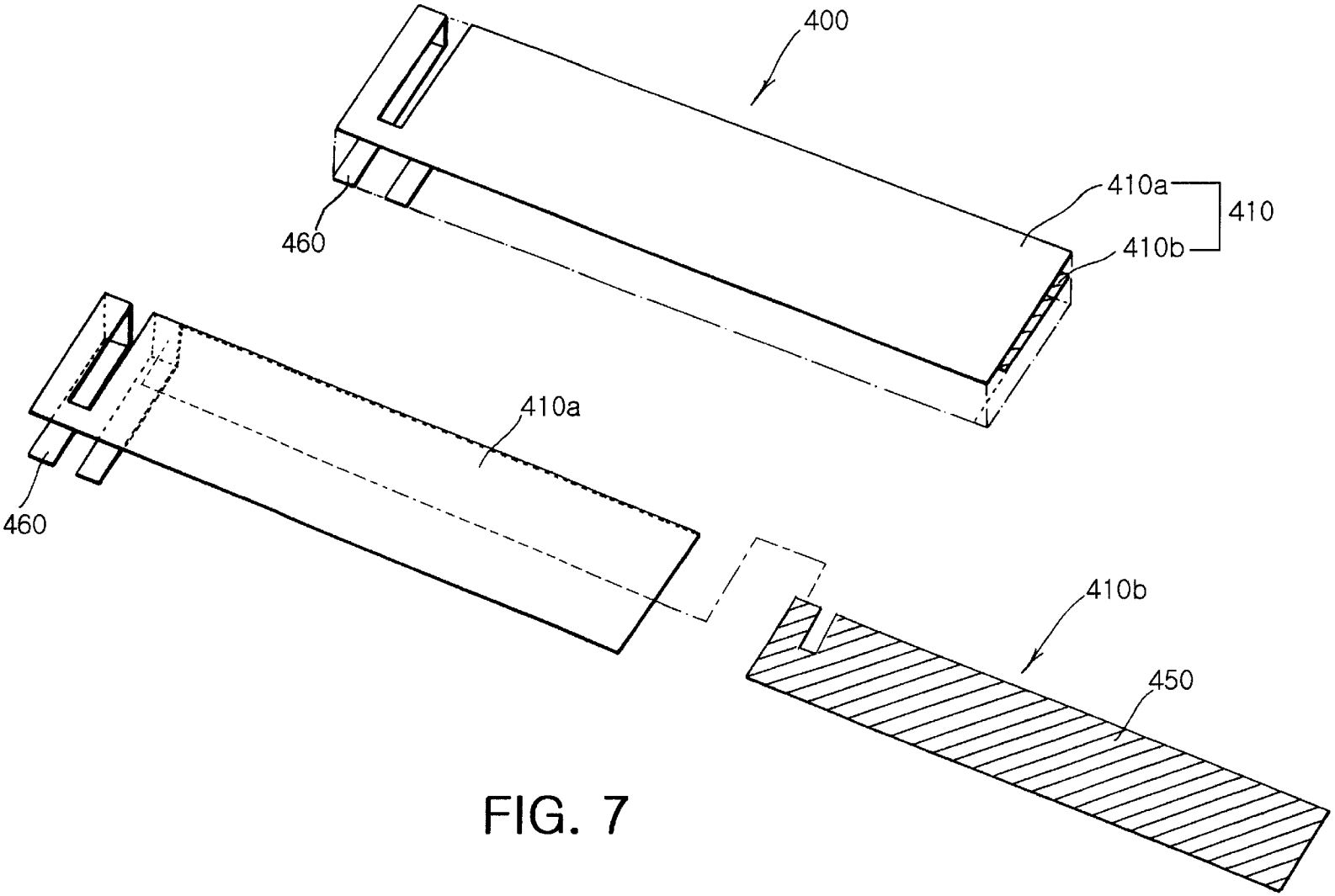
FIG. 7 is a view showing a conductor pattern of a chip antenna according to a fourth embodiment of this invention.

FIG. 7 is a view showing a conductor pattern 410 of a chip antenna according to a fourth embodiment of this invention. Referring to FIG. 7, a base block 400 of the chip antenna is made of one material of dielectric and magnetic substances and constructed in the form of a rectangular solid.

The conductor pattern 410 formed on the base block 400 is comprised of a primary conductor line 410*a* having an inverted F plate shape, and a secondary conductor line 410*b* connected in parallel with the primary conductor line 410*a* and formed in the shape of a combined inverted L/plate. Here, the primary conductor line 410*a* is transversely arranged with respect to the base block 400 with a plate shape.

Further, the secondary conductor line 410*b* is arranged under the primary conductor line 410*a* while being connected in parallel with the primary conductor line 410*a*.

At this time, the shape of an internal electrode 450 composed of the secondary conductor line 410*b* can be selected from the group including helix, meander line bent vertically and line shapes as well as a plate shape.

Further, the internal electrode 450 is formed inside of the lower portion of the base block 400 such that the secondary conductor line 410*b* is arranged under the primary conductor line 410*a* while being connected in parallel with the primary conductor line 410*a*, and the primary and secondary conductor lines 410*a* and 410*b* form independent conductor lines to each have a resonance frequency.

Moreover, the ground terminal 460 connected to the conductor pattern 410 can be freely adjusted in its area on the surface of the base block 400, thus allowing impedance matching of the chip antenna to be freely adjusted.

Figure 8:
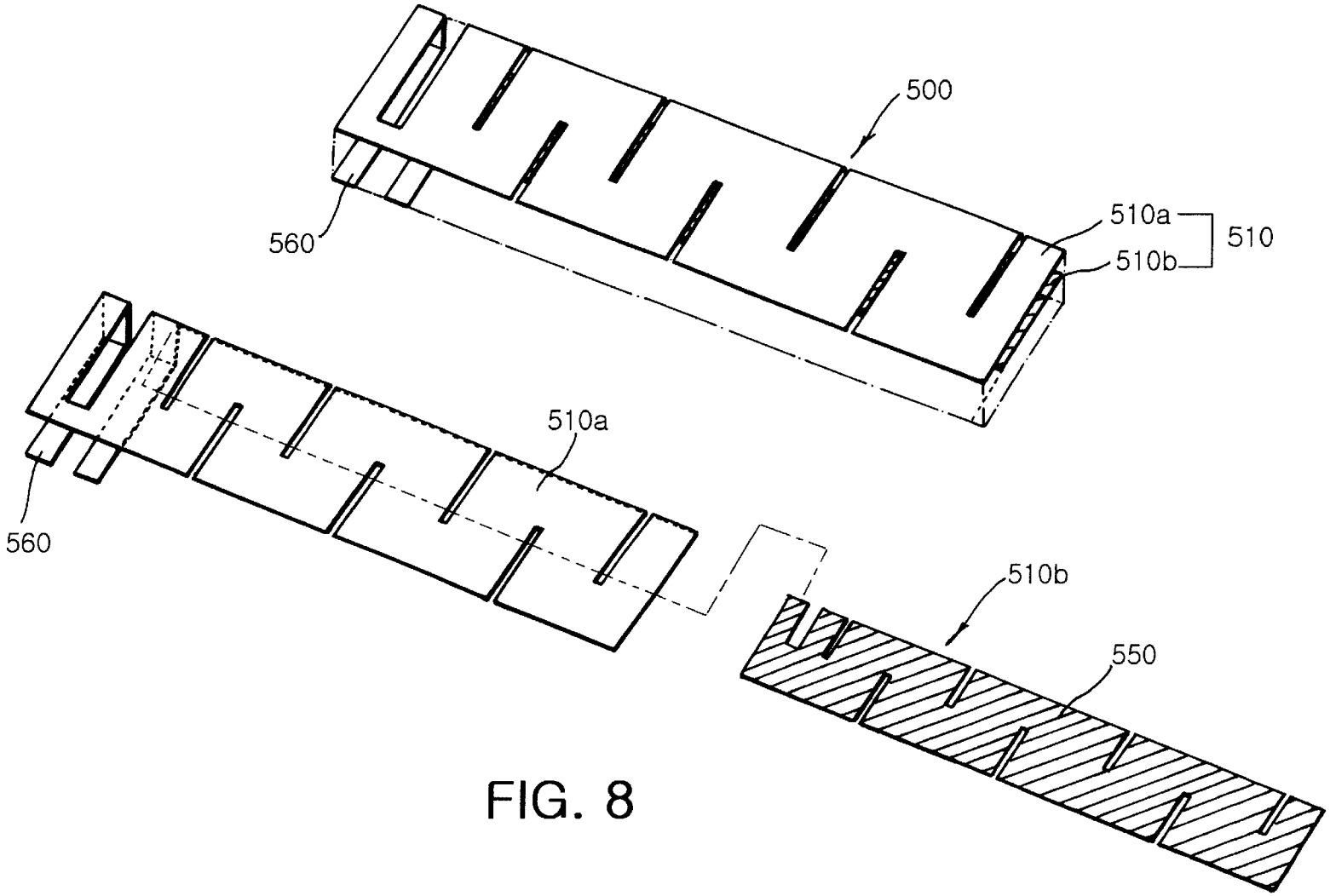
FIG. 8 is a view showing a conductor pattern of a chip antenna according to a fifth embodiment of this invention.

FIG. 8 is a view showing a conductor pattern 510 of a chip antenna according to a fifth embodiment of this invention. Referring to FIG. 8, a base block 500 of the chip antenna is made of one of dielectric and magnetic substances and constructed in the form of a rectangular solid.

The conductor pattern 510 formed on the base block 500 is comprised of a primary conductor line 510*a* having a slot shape, and a secondary conductor line 510*b* connected in parallel with the primary conductor line 510*a* and having a slot shape. Here, the primary conductor line 510*a* is transversely arranged with respect to the base block 500.

Further, the secondary conductor line 510*b* is arranged under the primary conductor line 510*a* while being connected in parallel with the primary conductor line 510*a*.

At this time, the shape of an internal electrode 550 composed of the secondary conductor line 510*b* can be selected from the group including helix, meander line bent vertically and line shapes as well as a slot plate shape.

Further, the internal electrode 550 is formed inside of the lower portion of the base block 500 such that the secondary conductor line 510*b* is arranged under the primary conductor line 510*a* while being connected in parallel with the primary conductor line 510*a*, and the primary and secondary conductor lines 510*a* and 510*b* form independent conductor lines to each have a resonance frequency.

Moreover, the ground terminal 560 connected to the conductor pattern 510 can be freely adjusted in its area on the surface of the base block 500, thus allowing impedance matching of the chip antenna to be freely adjusted.

As described above, the present invention provides a chip antenna, which is advantageous in that it can be miniaturized without the variation of the antenna characteristics, and the bandwidth of a single frequency can be improved by making conductor lines each with a resonance frequency get near to each other, thus increasing a frequency bandwidth.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A chip antenna, comprising:

a base block comprised of opposite top and bottom surfaces and side surfaces between the top and bottom surfaces, and made of one of dielectric and magnetic substances;

a primary conductor line formed at a portion of the base block and formed in the shape of an inverted F; and a secondary conductor line formed at a portion of the base block and formed in the shape of an inverted L, wherein the primary and secondary conductor lines are connected in parallel with each other.

2. The chip antenna according to claim 1, wherein the base block is constructed in the form of a rectangular solid.

3. The chip antenna according to claim 1, wherein the primary conductor line includes a conductor pattern extended along the length of the base block, a feeding terminal connected to one end of the conductor pattern, and a ground terminal connected to the other end of the conductor pattern.

4. The chip antenna according to claim 3, wherein the secondary conductor line is connected to a portion of the feeding terminal of the primary conductor line, and extended along the length of the base block.

5. A chip antenna, comprising:

a base block made of one material of dielectric and magnetic substances and constructed in the form of a rectangular solid;

a conductor pattern comprised of a primary conductor line having a plurality of side electrodes formed to helically wind around a portion of the base block and upper and lower electrodes connected to the side electrodes, the upper and lower electrodes each having extended portions formed therein, and a secondary conductor line formed inside of the base block such that the secondary conductor line is connected in parallel with the primary conductor line;

ground and feeding terminals connected to the conductor pattern; and an impedance adjustment electrode formed at a portion of the top surface of the base block such that it is connected between the primary conductor line and the ground terminal so as to adjust impedance.

6. The chip antenna according to claim 5, wherein the extended portion formed in the primary conductor line of the conductor pattern is projected at approximately 90 degrees.

7. The chip antenna according to claim 5, wherein the side electrodes are formed perpendicular to the top and bottom surfaces of the base block.

8. The chip antenna according to claim 5, wherein the upper and lower electrodes are each formed in the shape of an inverted L in which both ends of each of the upper and lower electrodes are connected to corresponding side electrodes.

9. The chip antenna according to claim 5, wherein the secondary conductor line formed inside of the base block is formed in the shape of a meander line bent vertically, or a helix.

10. The chip antenna according to claim 5, wherein the primary conductor line is formed to wind around the outer surface of the base block.

11. The chip antenna according to claim 5, wherein the secondary conductor line is formed to be arranged inside of the primary conductor line helically wound.

12. The chip antenna according to claim 5, wherein one of the upper and lower electrodes of the primary conductor line is formed inside of the base block.

13. The chip antenna according to claim 5, wherein the secondary conductor line is formed outside of the primary conductor line.

14. The chip antenna according to claim 5, wherein the ground and feeding terminals are connected in parallel with each other while being extended from one end of the conductor pattern, and formed on any one side surface of the base block.

15. The chip antenna according to claim 14, wherein the feeding terminal is extended from one end of the conductor pattern to the top, side and bottom surfaces of the base block, such that the feeding terminal surrounds a portion of the base block.

16. The chip antenna according to claim 14, wherein the ground terminal is extended from one end of the conductor pattern to the top, side and bottom surfaces of the base block, such that the ground terminal surrounds a portion of the base block.

17. The chip antenna according to claim 14, wherein the ground terminal is formed adjacent to an end portion of the base block, and the feeding terminal is formed between the conductor pattern and the ground terminal.

18. A chip antenna, comprising:

a base block made of one material of dielectric and magnetic substances and constructed in the form of a rectangular solid;

a conductor pattern comprised of a primary conductor line having a plurality of side electrodes formed to helically wind around at least one portion of the base block and upper and lower electrodes connected to the side electrodes, the upper and lower electrodes each having extended portions formed therein, and a secondary conductor line formed inside of the lower portion of the base block such that the secondary conductor line is arranged under the primary conductor line while being connected in parallel with the primary conductor line;

ground and feeding terminals connected to the conductor pattern; and an impedance adjustment electrode formed at a portion of the top surface of the base block such that it is connected between the primary conductor line and the ground terminal so as to adjust impedance.

19. A chip antenna, comprising:

a base block made of one material of dielectric and magnetic substances and constructed in the form of a rectangular solid;

a conductor pattern comprised of a primary conductor line transversely arranged with respect to the base block and formed in the shape of a combined inverted F/meander line, and a secondary conductor line formed inside of the lower portion of the base block while being connected in parallel with the primary conductor line and formed in the shape of an inverted L;

ground and feeding terminals connected to the conductor pattern; and an impedance adjustment electrode formed at a portion of the top surface of the base block such that it is connected between the primary conductor line and the ground terminal so as to adjust impedance.

20. The chip antenna according to claim 19, wherein the primary conductor line includes extended portions in which electrodes of the primary conductor line are projected at approximately 90 degrees.

21. A chip antenna, comprising:

a base block made of one material of dielectric and magnetic substances and constructed in the form of a rectangular solid;

a conductor pattern comprised of a primary conductor line arranged on the base block and formed in the shape of a plate such that the primary conductor line is transversely arranged with respect to the base block, and a secondary conductor line connected in parallel with the primary conductor line and formed in the shape of a plate, the secondary conductor line being formed inside of the lower portion of the base block such that it is arranged under the primary conductor line while being connected in parallel with the primary conductor line;

ground and feeding terminals connected to the conductor pattern; and an impedance adjustment electrode formed at a portion of the top surface of the base block such that it is connected between the primary conductor line and the ground terminal so as to adjust impedance.

22. A chip antenna comprising:

a base block made of one material of dielectric and magnetic substances and constructed in the form of a rectangular solid;

a conductor pattern comprised of a primary conductor line arranged on the base block, formed in the shape of a slot and transversely arranged with respect to the base block, and a secondary conductor line connected in parallel with the primary conductor line and formed in the shape of a slot, the secondary conductor line being formed inside of the lower portion of the base block such that it is arranged under the primary conductor line while being connected in parallel with the primary conductor line;

ground and feeding terminals connected to the conductor pattern; and an impedance adjustment electrode formed at a portion of the top surface of the base block such that it is connected between the primary conductor line and the ground terminal so as to adjust impedance.

* * * * *